US007765946B1

(12) United States Patent
Berman et al.

(10) Patent No.: US 7,765,946 B1
(45) Date of Patent: Aug. 3, 2010

(54) INTEGRATED BOW THRUSTERS

(75) Inventors: Ronald M. Berman, Port Orange, FL (US); Keith P. Ranieri, Edgewater, FL (US)

(73) Assignee: Boston Whaler, Inc., Edgewater, FL (US)

( * ) Notice: Subject to any disclaimer, the term of this patent is extended or adjusted under 35 U.S.C. 154(b) by 0 days.

(21) Appl. No.: 12/030,583

(22) Filed: Feb. 13, 2008

(51) Int. Cl.
*B63H 25/46* (2006.01)
*B63H 5/16* (2006.01)

(52) U.S. Cl. ..... 114/151; 440/68

(58) Field of Classification Search ..... 114/148, 114/150, 151, 65 R, 355; 440/38, 40, 42, 440/49, 53, 54, 61, 63, 67, 68; 416/155, 416/157 R, 158, 204 R, 244 RB, 244 B
See application file for complete search history.

(56) References Cited

U.S. PATENT DOCUMENTS

| | | | | |
|---|---|---|---|---|
| 3,515,088 | A | 6/1970 | Thulin | |
| 3,531,809 | A | 10/1970 | Hegg | |
| 4,294,186 | A * | 10/1981 | Wardell | 114/151 |
| 4,685,889 | A | 8/1987 | Nystrom | |
| 5,152,240 | A * | 10/1992 | Fontanille | 114/151 |
| 5,666,902 | A | 9/1997 | White et al. | |
| 6,009,822 | A | 1/2000 | Aron | |
| 6,363,874 | B1 * | 4/2002 | Griffith, Sr. | 114/151 |
| 6,726,865 | B2 | 4/2004 | Mielke et al. | |
| 7,146,921 | B2 * | 12/2006 | Fontanille et al. | 114/151 |
| 7,191,727 | B2 | 3/2007 | Buzzi | |

FOREIGN PATENT DOCUMENTS

| | | |
|---|---|---|
| EP | 0328499 | 8/1989 |

* cited by examiner

*Primary Examiner*—S. Joseph Morano
*Assistant Examiner*—Daniel V Venne
(74) *Attorney, Agent, or Firm*—Malin Haley DiMaggio Bowen & Lhota, P.A.

(57) ABSTRACT

A system and apparatus for providing integrated boat thrusters which eliminates interfering with the integrity of the hull, and undesirable drilling and cutting of the hull to accommodate separate glass tubes or pipes that are conventionally used to form thruster tunnels. The instant system provides integrally molded thruster tunnel sections within the hull, and unique keystone inserts which are complementary to the molded thruster tunnel sections and complete the water flow chambers through the hull about the propellers. Separate tubes are not utilized. Thruster motors and mounting mechanisms are securely fastened in flat planes enhancing strength, performance and maintenance of the assemblies. In a preferred embodiment, the keystone insert is generally wedge shaped to provide a secure fit and bond within the molded tunnel section having angled walls.

10 Claims, 10 Drawing Sheets

INTEGRATED BOW THRUSTERS

BACKGROUND OF THE INVENTION

1. Field of the Invention

The inventions disclosed herein relate generally to bow thrusters for marine vessels, and more particularly to novel methods and apparatus for incorporating bow thruster tunnels, motors and related equipment into boat hulls during the manufacturing process. The instant inventions eliminate the need and use of conventional glass tubes for such a process and the undesirable modifications to standard hulls through drilling and cutting of hull, as well as provide superior structural support for the thruster electrical and mechanical components.

2. Description of Related Art

Typical bow thruster installations require relatively large holes to be drilled through the hull, after the hulls original manufacture, and thereafter fiberglass tubes to be glassed in and finished to commercial standards. Such a process interferes with the structural integrity of the vessel, is inefficient, costly and time consuming. Additionally, this process can interfere with proprietary technology and methods for manufacturing boat hulls, such as that disclosed in Applicants' U.S. Pat. No. 6,726,865, Entitled COMPOSITE MATERIAL FOR VEHICLE HULLS AND HULL MOLDING PROCESS. Drilling large holes to create hull tunnels, for example 8 inches or larger, through the hull, laminates, structural components and layers would compromise the patented foam core. There is significant labor associated with the glass work and finish work associated with this type of conventional hull modification and thruster installation. It is very incompatible and unfriendly to the manufacturing environment due to the various multiple skill sets that need to be involved in the installation process to compensate for the separate requirements for subsequent modification of the hulls. These include the necessity for finishers, laminators, and experienced detail personnel for trim work, grinding procedures and the like. Eliminating the use and necessity for separate glass tunnels to be placed within a hull to receive power thrusters, and the concomitant relatively complex procedures and finishing work required, are key features of the instant inventions.

An example of a conventional bow thruster found in the prior art is U.S. Pat. No. 6,009,822 issued to Aron on Jan. 4, 2000, entitled "Bow or Stern Thruster". The '822 patent discloses a steering device for large commercial vessels. A multi-component gearbox houses a vertical shaft which drives two horizontal shafts for props, and a pair of propellers are disposed in a cylindrical pipe defining a tunnel placed transversely across either the bow or stern of the vessel. The pipe may be made of any corrosion resistant material. The diameter of the tunnel may vary.

A further example is shown in U.S. Pat. No. 3,515,088 issued to Thulin on Jun. 2, 1970, entitled "Bow Thruster". This patent teaches a thruster having a bulb with a partially spherical front end and an essentially cylindrical body portion merging into the ship's hull. There are two openings provided in the side walls of the cylindrical portion located diametrically opposite to each other. In the bulb proper, a tunnel structure enclosing a propeller is located. The tunnel structure is pivotably supported in the bulb and in the bulkhead and swings about a horizontal axis.

European Patent Application Publication No. 0,328,499 A1 issued to Pichl discloses a Propulsion Device for Steering a Boat, and Method of Producing a Hull, in which a hull is produced with a recess toward the bottom of the keel. The recess receives a gear/flywheel type motor, propeller aggregate assembly, the assembly being housed within a separate tunnel and cover unit of custom "V" shaped design to receive the propellers and provide flow chambers. The tunnel has an internal housing which accepts the propeller assembly, and transitions to the flow tunnels. This is a convoluted mechanical and structural design and method of manufacture, and impractical by current standards.

The prior art generally relates to conventional thrusters which use fiberglass tube inserts which are secured within cylindrical cavities drilled through the boat hulls. The tubes provide the water channels for flow when the thrusters are activated and switched on. The hulls are manufactured using a multitude of multi-layer composites, laminates and structural components of various materials and cores, as well as bow thruster designs per se.

Applicants' inventions herein eliminate the use and necessity of invading the integrity of the hull, use of separate glass tunnel, cylindrical or pipe inserts, and substantial labor and finishing work required by current and common techniques in the marine industry.

SUMMARY OF THE INVENTION

Applicants' inventions relate to boat bow thrusters which are mounted within specially molded cavities in the boat hull. The instant inventions eliminate the need for separate auxiliary tubes or channels and finishing work, and integrate the thruster tunnels being molded into the hull in the initial process of manufacture. A separate complementary and molded "keystone" insert is secured and bonded to the hull to complete the tunnel and the hull bottom. The keystone insert can be unitary, or can comprise distinct sections.

Each thruster motor is mounted inside the hull on a flat, stabilizing inner liner which provides structural support. A shaft protrudes into the thruster tunnel to mate with and control the propeller.

Unique procedures are utilized to complete the installation process, including alignment and guide tools, securing the structural components and installing the keystone insert. Because the integrity of the hull is not breached, and a superior design is utilized for the thruster motor supports, an enhanced system is achieved in manufacturing and performance, as well as eliminating undesired vibration, noise and maintenance.

This invention provides a clean and clever solution to the problems set forth above, is seamless in terms of integrating the system into conventional boat construction and manufacturing techniques with minimal valiance, is financially sound, and easy to service.

In accordance with the instant inventions, it an object thereof to provide an improved method and apparatus for installing bow thrusters into marine vessel hulls, which eliminates the process of cutting the hulls, drilling cavities within the hull or hull core, or otherwise modifying the hull to accommodate separate or auxiliary components for thruster installation.

It is a further object of the instant invention to provide an improved method and apparatus for installing bow thrusters into marine vessel hulls which incorporates a superior mechanical and electromechanical design, is operationally efficient, and is easy to maintain.

It is a further object of the instant invention to provide an improved method and apparatus for installing bow thrusters into marine vessel hulls which is cost-effective and of a superior manufacturing design.

A further object of the present invention is to provide an improved method and apparatus for manufacturing and installing bow thrusters into marine vessel hulls which includes all of the above mentioned features and objects to provide a substantially superior design, eliminating the problems encountered by prior methods and devices, and generally solving problems associated with incorporating bow or stern thrusters into hull without interfering with the primary hull design, function or materials.

These and other objects, advantages, and features of Applicants' inventions will become clear as this description proceeds hereinafter. The inventions accordingly comprise the features of construction, manufacturing methods, engineering designs, materials and components, the interrelationship thereto, combination of elements, and arrangement of parts that will be exemplified in the description set forth hereinafter.

In accordance with these and other objects which will become apparent hereinafter, the instant inventions will now be described with particular reference to the accompanying drawings.

DETAILED DESCRIPTION

Figure 1:
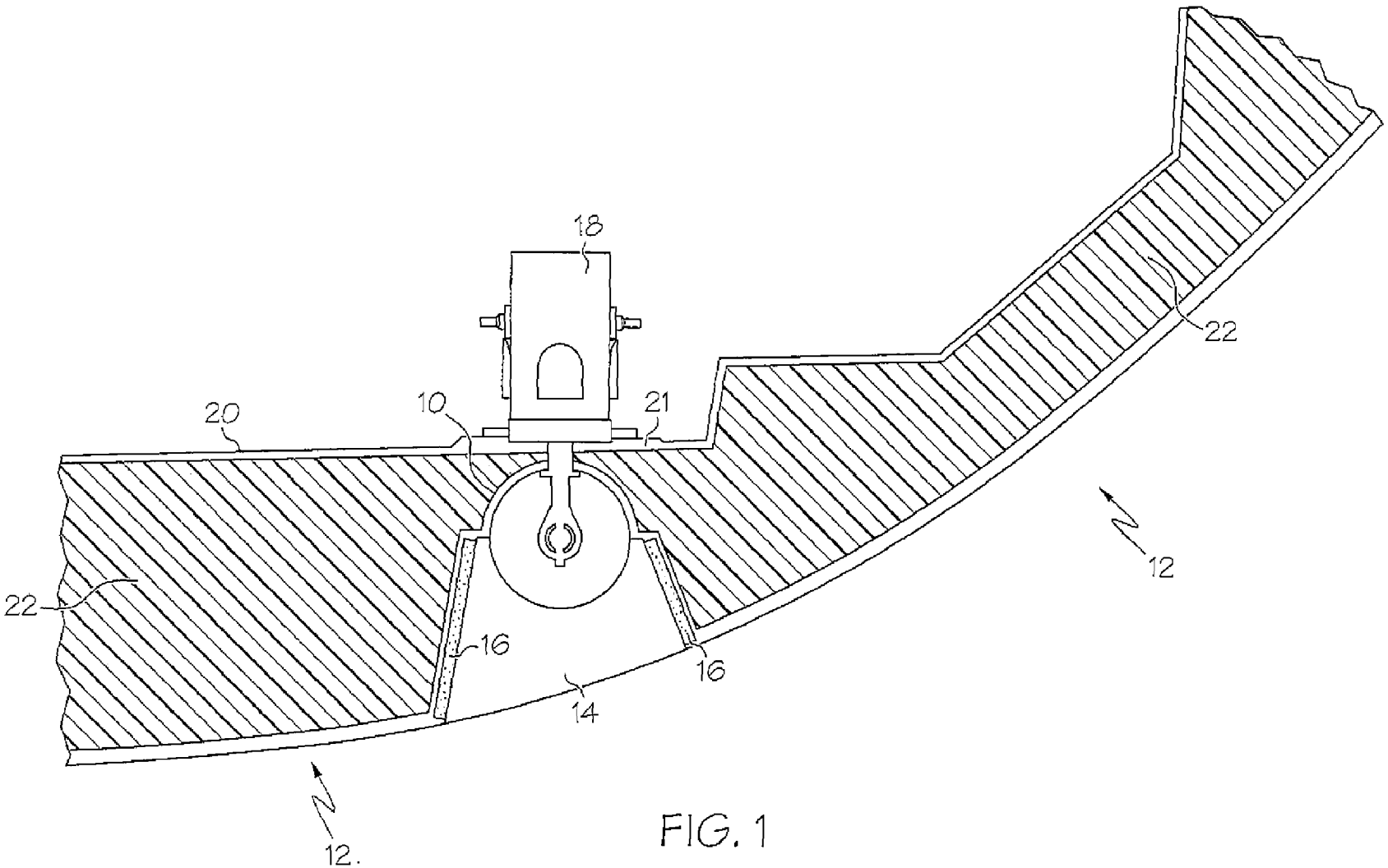
FIG. 1 illustrates partial cross-sectional view of the hull and bow thruster installation.

FIG. 1 shows a cross-sectional view of the hull and bow thruster installation. Although depicted in the bow area, it is understood that fore, mid-section, and/or aft thrusters can be utilized in vessel hulls at any location utilizing the technology and manufacturing methods described herein. The top of the bow thruster tunnel 10, and the area for insertion of the keystone insert, are integrally molded into the hull bottom 12 of a boat hull during the original manufacturing process. That is, no subsequent cutting, drilling of holes or cavities, or modification of the hull is required to accommodate the installation of the thruster or propeller assemblies as hereinafter described. A separate keystone insert 14 mates with the molded hull tunnel section and is bonded to the hull using bond lines 16 on opposite sides. Keystone insert 14 is bonded to the bottom half of the tunnel section 10 and completes the thruster propeller tunnel channeling water flow about the thruster propeller in a defined area.

As further illustrated in FIG. 1, a thruster motor 18 is mounted to the inner liner 20 of the hull at a location directly above the tunnel 10. It is contemplated that the motor 18 is mounted onto a generally flat, horizontal surface 21 reinforced for stability as further described below. The motor assembly and supporting hardware is mounted directly to the inner liner 20 of the hull structure providing further stability and structural support for the motor and propeller base. In Applicants' proprietary hull manufacturing process, as disclosed and claimed in U.S. Pat. No. 6,726,865, foam in injected into the inner and outer hull sections, essentially filling all voids and forming the hull core. This provides many optimum benefits as described in the '865 patent, including superior strength, structural integrity, noise and vibration reduction and elimination, and ultimately a superior marine vessel for operation when encountering hydrodynamic forces, wave action, chop and the like. Providing a complete foam cross-section 22 within the boat hull walls substantially reduces noise and vibration created by the propulsion motors, both outboards and inboards, and provides for a smoother ride in lake or ocean conditions. In the context of the instant application, the foam core 22 provides additional support for the mounting saddle, thruster motor and propeller assemblies. This manufacturing process further allows for the molding method of integrally forming the tunnel section and enhanced strength in bonding with the keystone insert. However, it is understood that the instant inventions can be incorporated into a variety of conventional hull manufacturing techniques, and they do not require foam filled hull cross-sections.

The present inventions also completely eliminate the need for separate auxiliary tubes or pipes, discrete cylindrical channels, and related finishing work, as the thruster tunnel sections are integrally molded into the hull in the initial process of manufacture and tunnels are completed with the novel keystone inserts.

As mentioned, the thruster motor is mounted directly above the molded-in tunnel section and mounted to the inner hull liner. It is secured directly to the hull structure providing an extremely strong and reliable installation, as opposed to, and instead of, a separately glassed in tube. The thruster motor and propeller assemblies then operate with much less vibration than traditional bow thruster installations, resulting in less noise and maintenance. Furthermore, as holes are not drilled through the boat hull to receive a separate thruster tube, the hull composite materials, bottom laminates, coatings and fiberglass are not breached or compromised thereby eliminating weak areas or potential fault zones, and is also more tolerant of manufacturing variations and necessary changes.

Figure 2A:
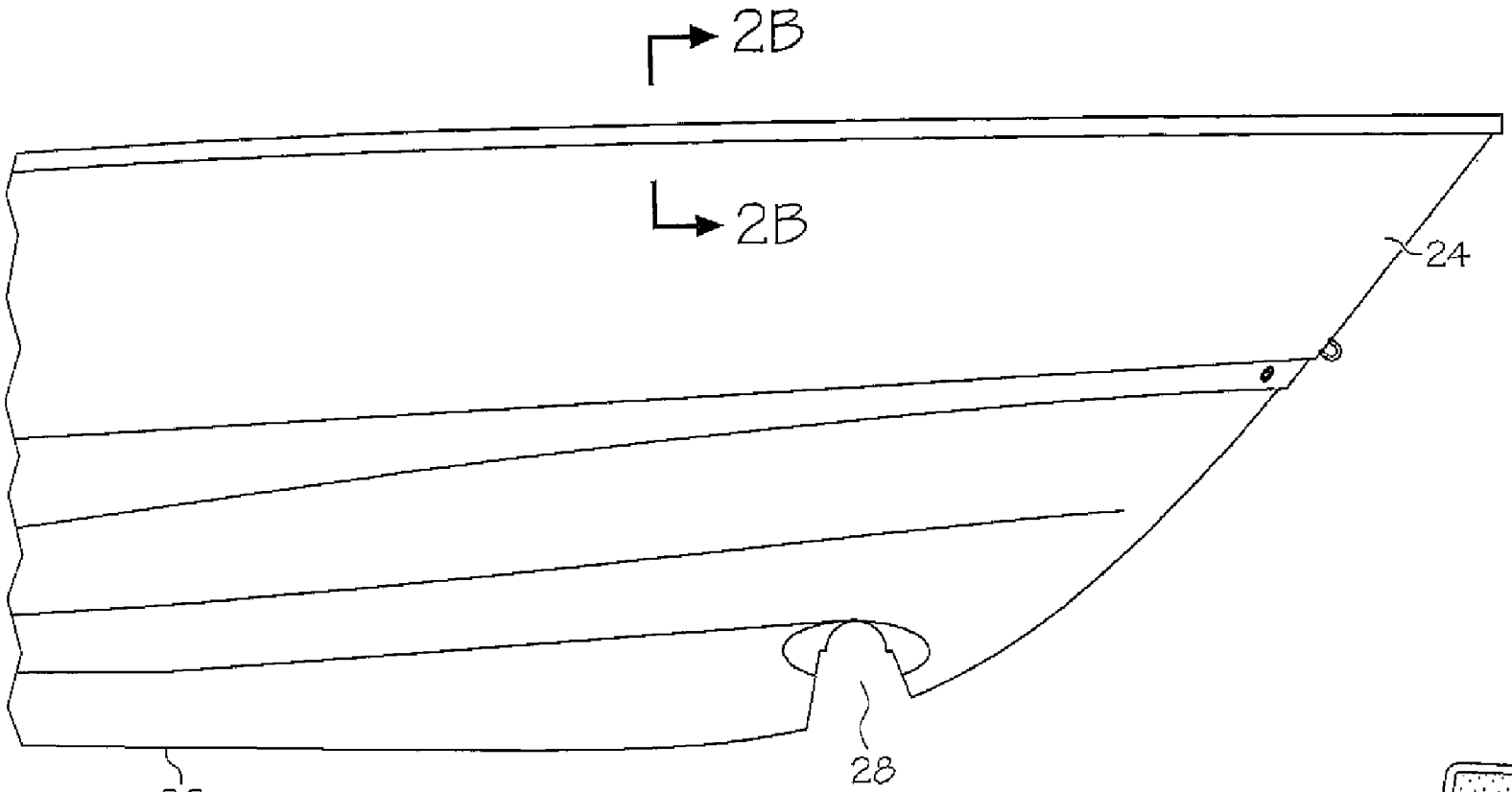
FIG. 2A illustrates a side plan view of the bow area of the boat hull and the molded tunnel section of the instant invention.

FIG. 2A depicts the bow area 24 of the boat hull, along with the bottom area 26 of the hull. As illustrated, the fore section of the hull is molded to integrally form the thruster tunnel section 28, which shows the recessed void area for receiving the keystone insert 14.

Figure 2B:
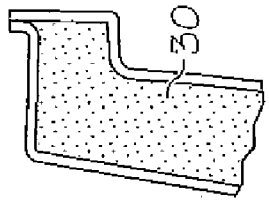
FIG. 2B illustrates a cross-sectional view taken along lines 2B of FIG. 2A.

FIG. 2B is a cross-sectional depiction of the upper hull gunnel area taken along lines 2B of FIG. 2A. Foam core 30 fills the area between the hull walls, providing a rigid and durable hull structure.

Figure 3:
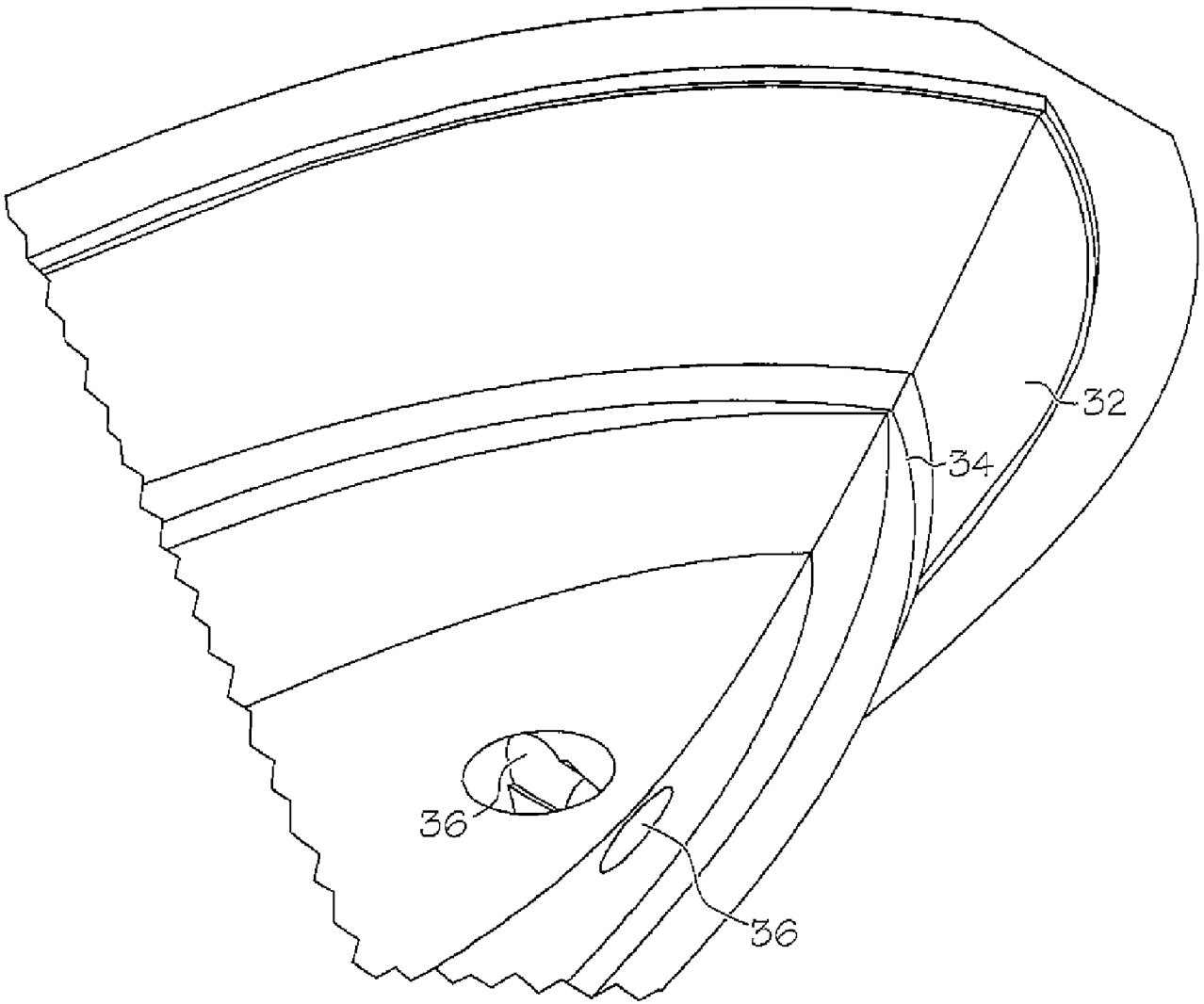
FIG. 3 is a bottom perspective view of the bow area of the boat hull depicting the tunnel entrances.

FIG. 3 illustrates a perspective view of bottom and fore bow area of the hull 32, as well as the intersection 34 of chine and strake lines. Thruster tunnels 36 are located towards the bottom of the bow hull area, and are beneath the water line of the vessel.

Figure 4:
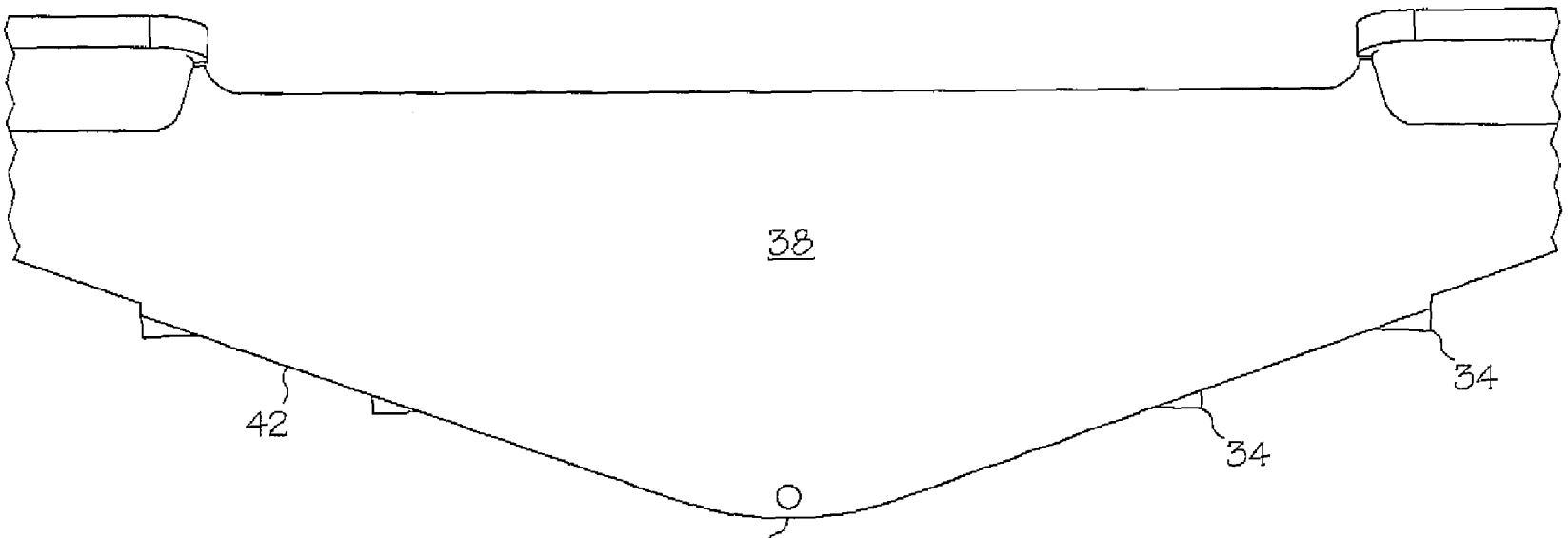
FIG. 4 depicts the transom, aft area of the vessel hull.

The transom area 38 of the hull is set forth in FIG. 4, a rear plan view. The intersections 34 of the chine and strake lines are shown, along with the relative angle 42 of the converging bottom hull walls, terminating in the vessels center-line 40. The integrally molded thruster tunnels of the instant inventions can be readily incorporated in the hull sections near the transom area 38, thereby providing aft thruster as desired. That is, multiple thruster tunnels can be incorporated into a given hull, depending on the design choices as readily apparent to one skilled in the art.

Figure 5:
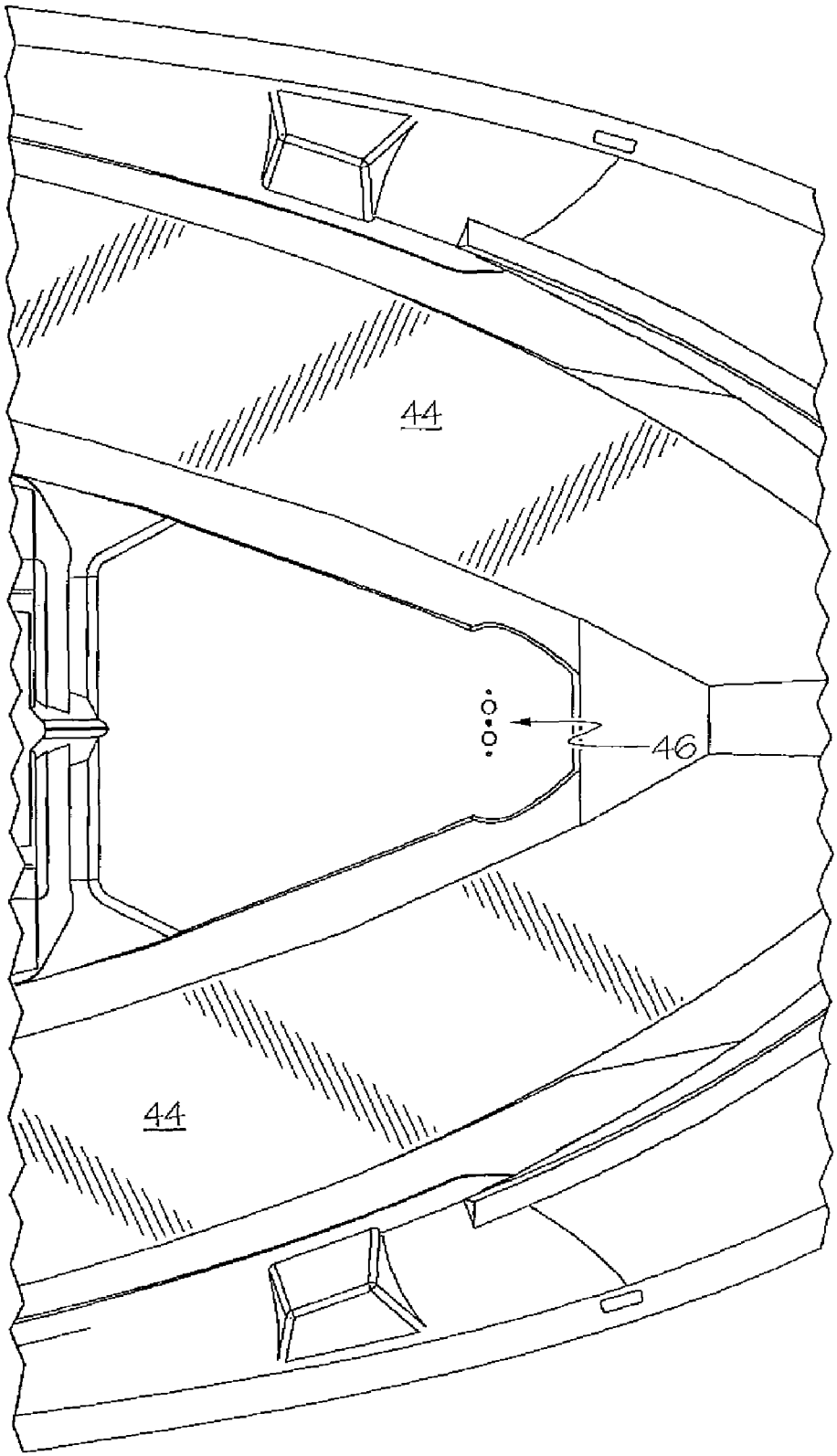
FIG. 5 depicts a top plan sectional view of the bow area of the boat hull where a thruster motor is installed.

FIG. 5 depicts a top plan sectional view of the bow area 44 of the boat hull where a thruster motor can be installed. The thruster motor is generally positioned in area 46, and mounted with support base and securing hardware as described in detail hereinafter.

Figure 6:
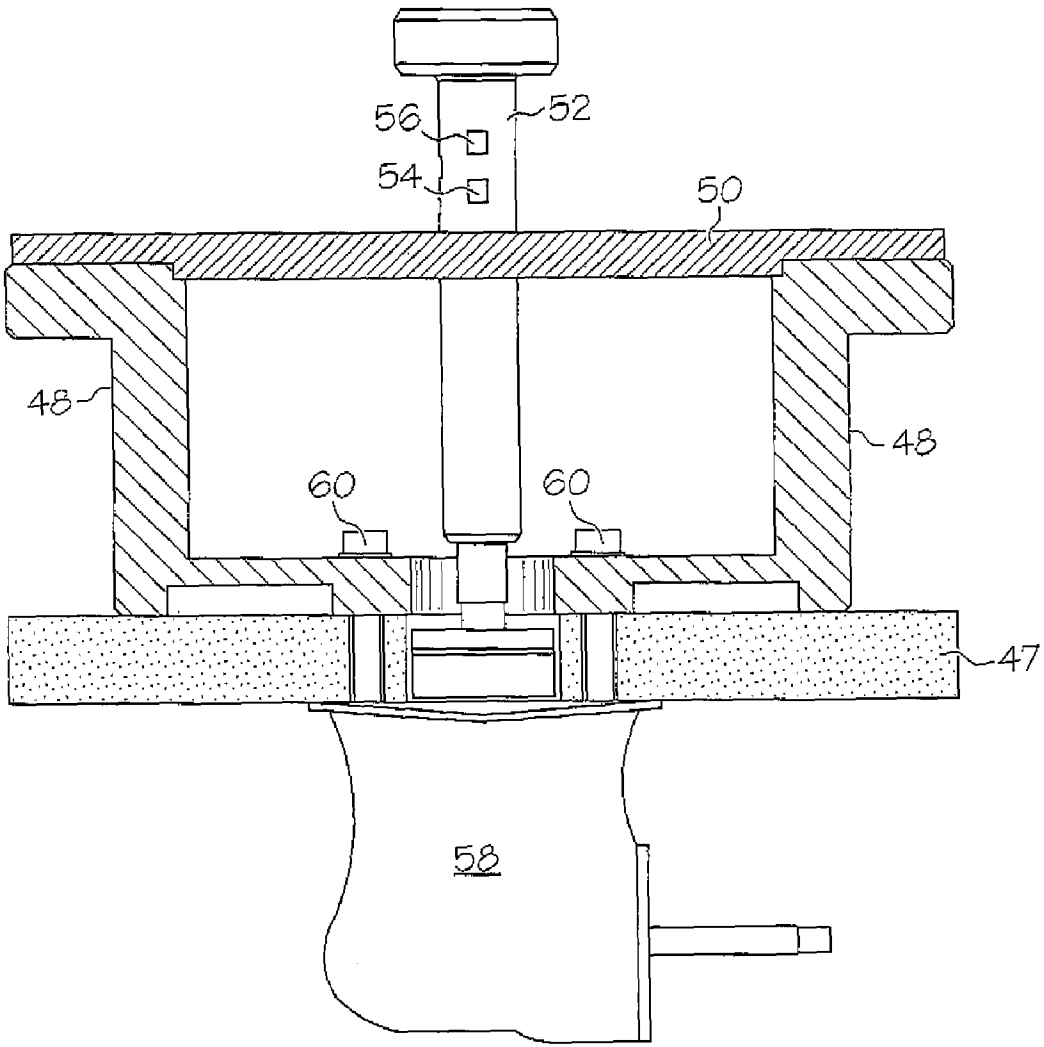
FIG. 6 illustrates a cross-sectional view of the mounting saddle and depth gauge utilized prior to installation of the thruster motor to the hull inner liner.

FIG. 6 illustrates a cross-sectional view of the mounting saddle 48, upon which the thruster motor is secured, and depth gauge 52 utilized prior to installation of the thruster motor to the hull inner liner. Mounting saddle 48 is secured directly to the hull 47 utilizing bolts 60. The saddle 48 is placed about the pre-drilled holes through the hull to the thruster tunnel (as shown in FIG. 5, area 46). Bolts 60 are placed through the saddle 48, through the hull 47, and are threaded into the propeller base/hub unit 58. In this manner, the saddle (and subsequently the thruster motor) is mounted and secured directly to the vessel hull in conjunction with the propeller assembly.

FIG. 6 further shows the depth gauge 52 and gauge plate 50, which are utilized to measure and determine pin placement for the universal joint which is interposed the thruster motor, mounting saddle and propeller base as described hereinafter. Dept gauge windows 54 and 56 determine the precise placement of the pins within the couple for proper alignment, mounting and operation of the thruster motor assemblies.

Figure 7:
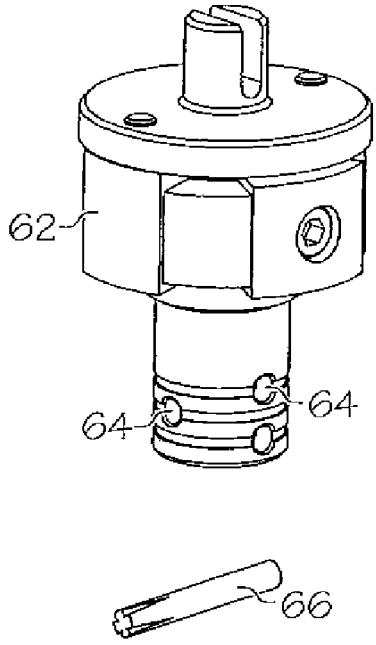
FIG. 7 is a perspective view of the universal joint which couples the thruster motor to the propeller base housing.

FIG. 7 is a perspective view of the universal joint 62 which couples the thruster motor to the propeller base housing 58. Recessed holes 64 can selectively receive pins 66 based upon appropriate readings of the depth gauge 52.

Figure 8:
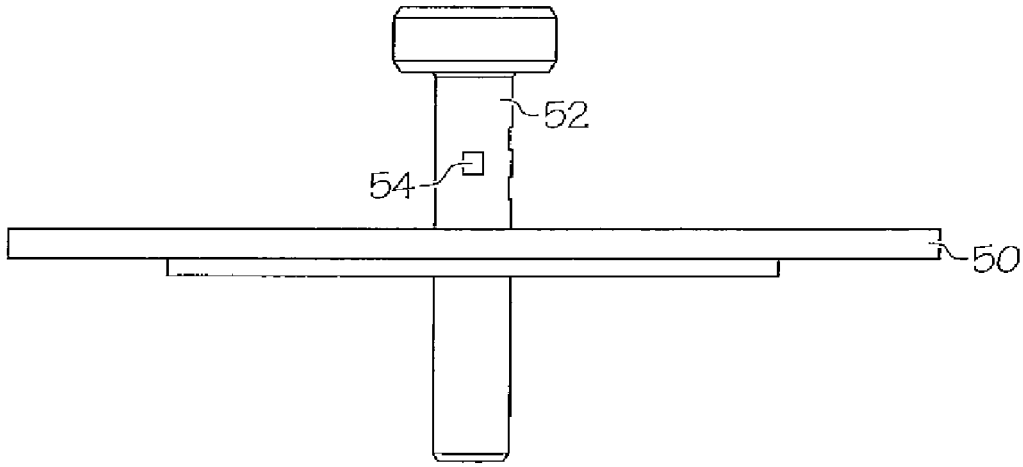
FIG. 8 is a side plan view of the gauge pin and gauge plate to determine pin insertion into the universal joint coupler.

FIG. 8 is a side plan view of the depth gauge 52, gauge window 54 and gauge plate 50. As set forth above, the gauge is utilized to determine pin insertion into the universal joint coupler.

Figure 9:
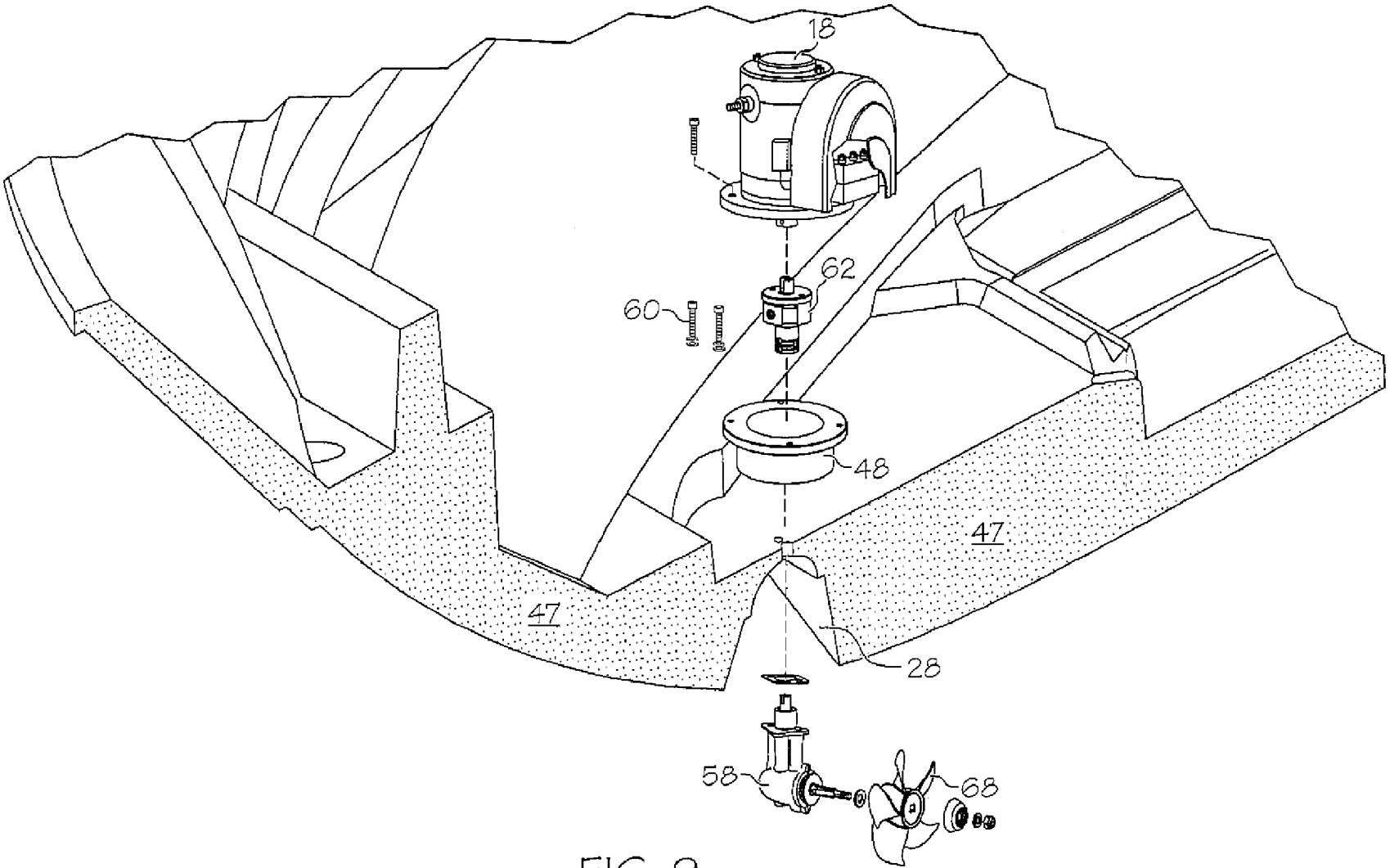
FIG. 9 is a perspective exploded partial cross-sectional view illustrating the hull and hull thruster tunnel, and installation of the thruster motor, universal joint, mounting saddle, propeller mounting base and hub, propeller and related hardware.

The generally assembly of the instant inventions are illustrated in FIG. 9, which represents a perspective exploded cross-sectional view depicting the hull and hull thruster tunnel, and installation of the thruster motor, universal joint, mounting saddle, propeller mounting base and hub, propeller and related hardware. Mounting saddle 48 is secured to the hull 47 and propeller base unit 58 by hardware and bolts 60, the latter being placed through pre-drilled holes in the bow hull area. Universal joint coupler 62 is then interposed thruster motor 18 and propeller base 58, the coupler placed within mounting saddle 48. The universal joint coupler engages the drive shafts of both the thruster motor 18 and propeller base unit 58, as apparent to one of ordinary skill in the art. The thruster motor 18 is securely mounted to the mounting saddle 48 utilizing appropriate hardware, bolts, nuts and the like. The entire assembly is inherently vertically aligned through mating hole positions, hardware placements, flange alignment and coaxially positioning as shown by the dashed vertical axis in FIG. 9. Finally, propeller blade unit 68 is placed about the horizontal shaft of the propeller base unit 58, within molded tunnel section 28 of the vessel hull.

Figure 10:
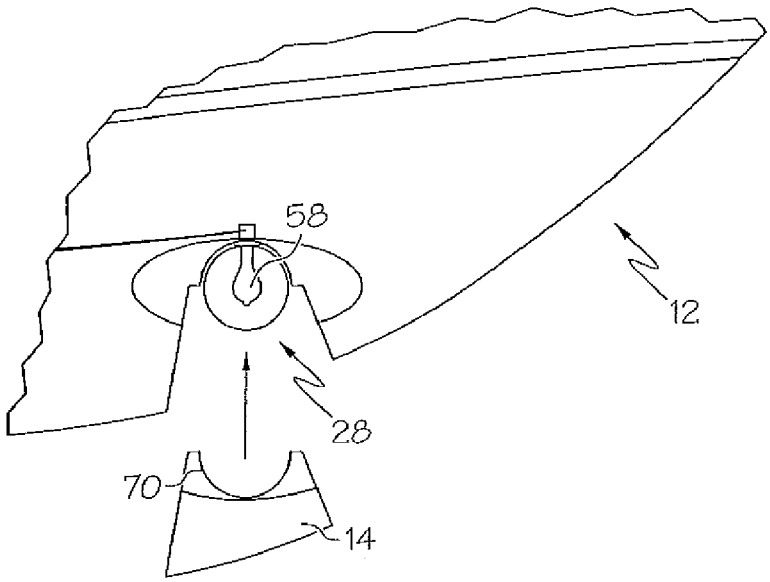
FIG. 10 is a partial side plan view showing the installation of the keystone insert to the hull tunnel section.

FIG. 10 is a partial side plan view showing the installation of the keystone insert 14 to the hull tunnel section 28. The propeller base unit 58 and related components have been previously installed as discussed above, and insertion of the keystone insert 14 completes the propellers tunnel within the hull. As shown, the keystone insert has a curved upper surface 70 to accommodate the rotation of the propeller blades and complete the curvature of the tunnel through the hull for channeling water flow. FIG. 10 illustrates the directional placement of the keystone insert 14, shown generally positioned upwardly to, and received within, the molded tunnel section 28.

Figure 10A:
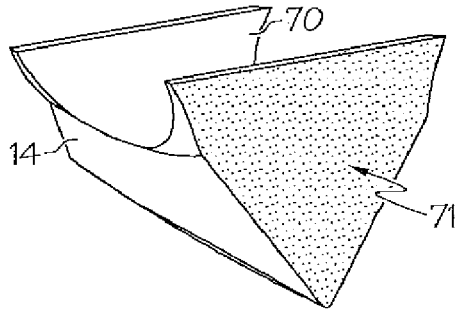
FIG. 10A is a perspective aft view of the keystone insert.

FIG. 10A is a perspective aft view of the keystone insert 14, further depicting the curved upper section 70. Appropriate bonding materials, chemicals and the like are applied to opposing surfaces 71 on the keystone insert 14.

Figure 10B:
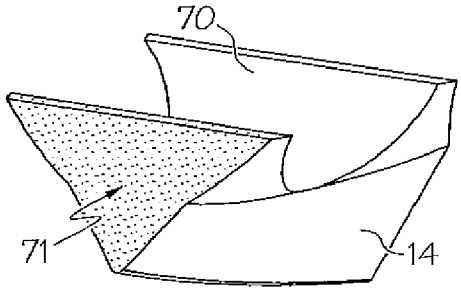
FIG. 10B is a perspective forward view of the keystone insert.

FIG. 10B is a perspective forward view of the keystone insert 14, having the same characteristics as shown in FIG. 10A. The angled based is to complement the angled base of the hull at the area of insertion, and to provide a continuous, seamless shape. The keystone insert can also be a unitary structure, or alternatively can be comprised of one or more discrete sections assembled together to form the complete keystone insert itself.

It is to be appreciated that the keystone insert 14 is described as a generally wedge-shaped unit to fit snuggly and securely with the relatively angled walls of hull tunnel 28. In one embodiment, the angled relationship of the interfacing components and unit walls facilitates a tight fit and the bonding process, as well as cosmetic finishing of the bottom hull along the seam lines. However, other geometric shapes for the keystone insert can be readily incorporated into the instant inventions, for both the complementary shapes of the keystone insert and molded hull tunnel sections.

Figure 11:
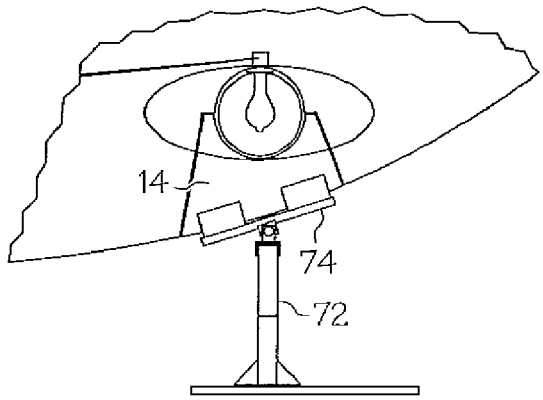
FIG. 11 illustrates the completed installation of the keystone insert, completing the thruster tunnel, and being secured in place by the brace mechanism to allow for bonding.

FIG. 11 illustrates the completed installation of the keystone insert 14, and mounted within tunnel hull section 28. A jack and base unit 72 acts as a brace mechanism, and is used to hold the keystone insert in place and allow for complete curing of the bonding materials. This completes the thruster tunnel, and forms a chamber within the hull for the flow of water about the thruster propeller blades.

Figure 12:
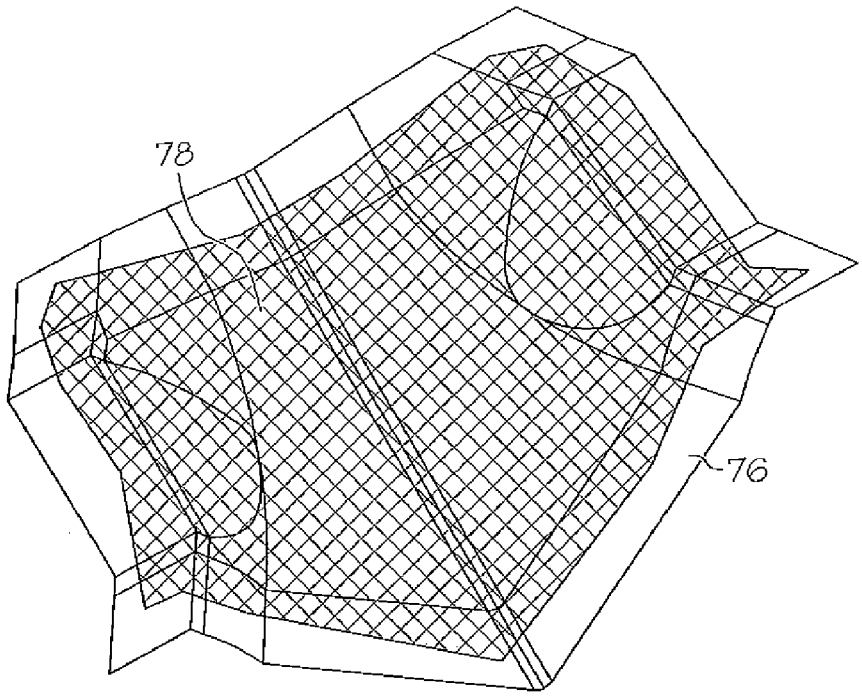
FIG. 12 is a bottom plan view of the upper section of the bow thruster cap plate.

FIG. 12 is a bottom plan view of the upper section of the bow thruster cap plate 76. Multiple layers 78 can be incorporated into the process and lamination schedule, including gelcoats, skincoats, bulkcoats and the like.

Figure 13:
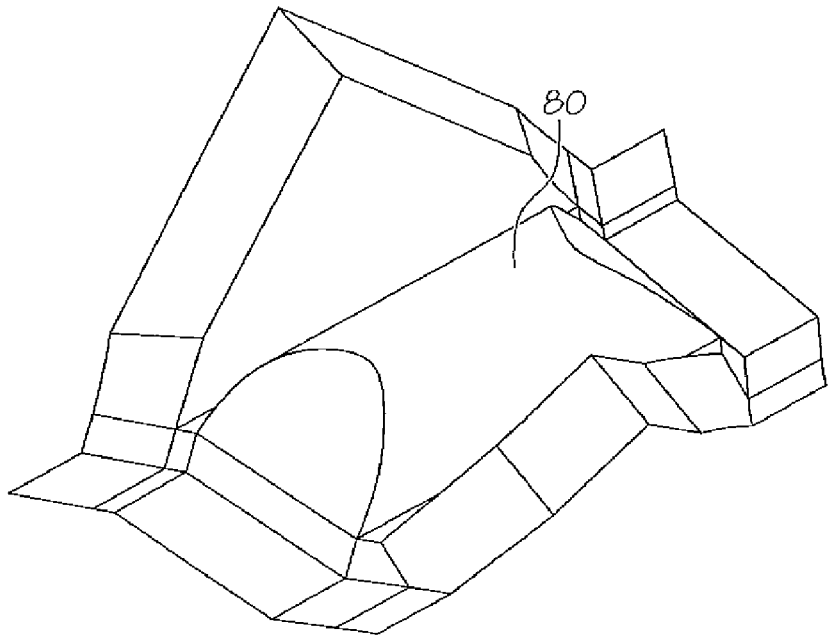
FIG. 13 is a top plan view of the lower section of the bow thruster cap plate.

FIG. 13 is a top plan view of the lower section 80 of the bow thruster cap plate. The upper and lower sections of the mold are joined together, bonded and can be kept in place by clamps for permanent curing.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A thruster and hull tunnel assembly for a marine vessel hull, comprising:

said vessel hull having an interior section and exterior section;

an integrally molded thruster tunnel section formed in said exterior section of said vessel hull;

a mounting member secured to said vessel hull interior section;

a thruster motor attached and secured to said mounting member;

a propeller base unit for receiving a propeller blade unit;

said propeller base unit attached to said vessel hull exterior section within said integrally molded thruster tunnel section, said propeller base unit secured in place to said integrally molded thruster tunnel section;

said propeller base unit being securely mounted within said integrally molded thruster tunnel section, and further to said mounting member by hardware means for fastening attached through said vessel hull;

a keystone insert, said keystone insert forming a complementary shape to said integrally molded thruster tunnel section;

said keystone insert being placed and securely mounted within said integrally molded thruster tunnel section; and said keystone insert completing a chamber within said vessel hull for water flow about said propeller base unit.

2. The assembly of claim 1, further comprising:

a universal joint coupler positioned within said mounting member for coupling said thruster motor and said propeller base unit.

3. The assembly of claim 1, further comprising:

said vessel hull interior section including a generally flat area, said mounting member and said thruster motor being secured to said vessel hull interior section in a generally horizontal plane.

4. The assembly of claim 1, further comprising:

said mounting member, said thruster motor and said propeller base unit being coaxially aligned with one another about said integrally molded thruster tunnel section.

5. The assembly of claim 1, further comprising:

said integrally molded thruster tunnel section having opposing side walls, said side walls being angled with respect to one another.

6. The assembly of claim 5, further comprising:

said keystone insert being of a general wedge shape, complementing the shape of said integrally molded thruster tunnel section side walls;

said keystone insert placed within, and mating to, said integrally molded thruster tunnel section.

7. The assembly of claim 6, further comprising:

said integrally molded thruster tunnel section having a curved upper section for accommodating the rotation of propeller blades;

said keystone insert having a curved upper section for accommodating the rotation of propeller blades;

said integrally molded thruster tunnel section curved upper section and said keystone insert upper section complementing one another and forming a generally cylindrical chamber through said vessel hull allowing for the flow of water about said propeller base unit.

8. A thruster and hull tunnel assembly for a marine vessel, which eliminates undesirable drilling or cutting of the vessel hull, and eliminates the use of a separate tube to provide a tunnel, comprising:

said vessel hull having an interior section and exterior section;

an integrally molded thruster tunnel section formed in said exterior section of said vessel hull;

said integrally molded thruster tunnel section having opposing side walls, said side walls being angled with respect to one another;

a mounting member secured to said vessel hull interior section;

a thruster motor attached and secured to said mounting member;

a propeller base unit for receiving a propeller blade unit;

a coupler positioned within said mounting member for coupling said thruster motor and said propeller base unit;

said propeller base unit attached to said vessel hull exterior section within said integrally molded thruster tunnel section, said propeller base unit secured in place to said integrally molded thruster tunnel section;

a keystone insert, said keystone insert forming a complementary shape to said integrally molded thruster tunnel section;

said keystone insert being of a general wedge shape, complementing the shape of said integrally molded thruster tunnel section side walls;

said keystone insert being placed within, securely mounted and mating to, said integrally molded thruster tunnel section;

said keystone insert completing a chamber within said vessel hull allowing for water flow about said propeller base unit.

9. The assembly of claim 8, further comprising:

said integrally molded thruster tunnel section having a curved upper section for accommodating the rotation of propeller blades;

said keystone insert having a curved upper section for accommodating the rotation of propeller blades;

said integrally molded thruster tunnel section curved upper section and said keystone insert upper section complementing one another and forming a generally cylindrical chamber through said hull allowing for the flow of water about said propeller base unit.

10. The assembly of claim 8, further comprising:

said vessel hull interior section including a generally flat area, said mounting member and said thruster motor being secured to said vessel hull interior section in a generally horizontal plane.

* * * * *